US005269649A

United States Patent [19]

Kiefer et al.

[11] Patent Number: 5,269,649

[45] Date of Patent: Dec. 14, 1993

[54] PRE-ROTATIONAL SWIRL CONTROLLER FOR ROTARY PUMPS

[75] Inventors: Ludwig Kiefer, Weinsheim; Jörg Löw, Mutterstadt; Horst Lottermoser, Grüstadt; Kurt Müller, Worms, all of Fed. Rep. of Germany

[73] Assignee: Halberg Maschinenbau GmbH, Ludwigshafen, Fed. Rep. of Germany

[21] Appl. No.: 887,077

[22] Filed: May 22, 1992

[30] Foreign Application Priority Data

May 24, 1991 [DE] Fed. Rep. of Germany ..... 4117025

[51] Int. Cl.[5] ..... F04D 29/46

[52] U.S. Cl. ..... 415/148; 415/160; 415/209.2; 415/201

[58] Field of Search ..... 415/148, 150, 155, 159, 415/160, 162, 191, 208.1, 209.2, 209.3, 201

[56] References Cited

U.S. PATENT DOCUMENTS

| | | | |
|---|---|---|---|
| 2,500,070 | 3/1950 | Hagen | 415/162 |
| 2,606,713 | 8/1952 | Bauger . | |
| 2,854,211 | 9/1958 | Bendersky | 415/162 |
| 3,377,799 | 4/1968 | Geyer | 415/160 |
| 3,695,777 | 10/1972 | Westphal et al. | 415/208.1 |
| 4,014,627 | 3/1977 | Heurteux | 415/201 |
| 4,531,372 | 7/1985 | Slabaugh | 415/160 |
| 4,734,007 | 3/1988 | Perry | 415/201 |
| 4,780,055 | 10/1988 | Zloch et al. | 415/160 |
| 4,940,386 | 7/1990 | Feuvrier et al. | 415/209.2 |
| 5,108,256 | 4/1992 | Herbst et al. | 415/160 |

FOREIGN PATENT DOCUMENTS

| | | |
|---|---|---|
| 2447891 | 4/1976 | Fed. Rep. of Germany . |
| 56595 | 8/1937 | Netherlands . |
| 146452 | 10/1921 | United Kingdom . |
| 671607 | 5/1952 | United Kingdom . |
| 2201732 | 9/1988 | United Kingdom . |

*Primary Examiner*—John T. Kwon

*Attorney, Agent, or Firm*—Chilton, Alix & Van Kirk

[57] ABSTRACT

Pre-rotational swirl controller for rotary pumps having a flow duct enclosed by a casing and a plurality of guide vanes located substantially radially within it. Each of these has two bearings, i.e. one on a hub located centrally and one on a trunnion which passes through the casing and which is also acted upon by an adjusting device. The guide vanes can be radially assembled through the casing because, for each guide vane, there is a removal slot which is closed by a cap which carries the seal and the bearing for the guide-vane trunnion, these being designed so as to be tolerant of alignment errors. A self-locking setting gear with a large transmission ratio and a through drive shaft is provided for the adjustment.

18 Claims, 3 Drawing Sheets

24
25
23

28
26
16
11
12
3
17
19
21
20
4
5
X
10
9
8
7
6
14
16
13
11
15

PRE-ROTATIONAL SWIRL CONTROLLER FOR ROTARY PUMPS

BACKGROUND AND SUMMARY OF THE INVENTION

It is known art (DE-PS 1 116 973; Deutsche Offenlegungsschrift 27 47 093) to make the guide vanes of a prerotational swirl controller for rotary pumps variable in order to match the pump to different operating conditions. For this purpose, each guide vane is cantilevered from a trunnion which is led, in a sealed manner, through the casing of the flow duct containing the guide vanes, is rigidly supported in a bearing located outside the casing and is connected to an adjusting device. This arrangement has the disadvantage that the vanes are susceptible to vibration so that the bearings, trunnions and seals have to be very strongly dimensioned and that large adjustment forces occur. The bearings must be rigid and must be accurately connected to the casing in the radial direction. This can be avoided if, in addition to being supported at their outer ends on the casing, the guide vanes are supported at their ends near the center on a stationary hub located in the center of the duct, the hub carrying the bearing devices for the ends of the guide vanes (GB-A-671607; GB-A146452; DE-A-2447891). In practice, however, guide vanes supported at both ends are seldom found because this arrangement still further increases the already existing problems with respect to the assembly, dismantling and maintenance of the guide vanes. In known pumps, in fact, it is generally necessary to dismantle the casing in order to obtain access to the guide vanes and replace them. Although it is known art (GB-A-2201732) to provide, in the casing of a gas turbine, an assembly opening—which can be closed by means of a cap—on the periphery of the compressor rotor so that the compressor blades fastened to the shaft can be individually removed when they are located in a suitable angular position, different preconditions exist in that case compared with the present invention because only one assembly opening is necessary for all the blades and the latter are moreover not located on the casing and are not adjustable.

The object of the invention is based on the creation of a pre-rotational swirl controller for rotary pumps with limited bearing requirements, permits easy assembly and dismantling of the guide vanes. The object is achieved by providing a pre-rotational swirl controller for rotary pumps. The pre-rotational swirl controller has a flow duct enclosed by a casing and a plurality of guide cans located substantially within the casing, each guide vane being supported on the casing at one end and on a permanently located hub at the other end. The controller includes an adjusting device for the guide vanes, and a bearing located on a cap piece or closure which closes an opening in the casing appropriate to the cross-sectional side of the guide vanes. The bearing is designed to be tolerant of alignment errors.

Because the guide vanes are supported at both ends, the casing-end guide vane bearing does not need to accept large forces nor does it need to be specially aligned. This opens the possibility of locating it on the cap piece or closure which closes an opening in the outside of the casing appropriate to the cross-sectional size of the guide vane. This in turn creates the possibility of removing and fitting the guide vane through the casing for maintenance purposes. On the other hand, the arrangement of the bearing on the cap also increases the alignment error possibilities, which are neutralized because at least the bearing provided on the casing for the guide vane trunnions (possibly including the associated seals) is designed to be tolerant of alignment errors. The accuracy requirements in the manufacture and fitting of the bearing and cap are substantially reduced by this means.

Alignment error tolerance is less critical on the hub-end bearing of the guide vanes because, on the one hand, the tolerances caused by the cap design involve practically no alignment errors and, on the other hand, the hub-end bearing can generally be designed to be short and simple and therefore less sensitive to alignment errors.

As known per se (U.S. Pat. No. 2,606,713), the adjusting device can include a rolling-contact supported ring for the common adjustment of the guide vanes. In the case of liquid pumps, such a measure has not previously been employed because it cannot introduce any substantial improvement due to high frictional forces occurring at the bearings and seals. On the other hand, the adjustment forces are further reduced in association with the invention in which the bearing and sealing forces are smaller.

In accordance with a particular feature of the invention, a setting gear with a through drive shaft is used in the adjusting device. This has the advantage that when several swirl controllers are arranged in series (for example for the different stages of a pump arrangement), a through drive shaft can be employed. This has a particularly close relationship to the features of the invention previously mentioned because it is only due to these that the adjusting forces are so reduced that the drive shaft can be designed to be so thin that a through arrangement is advantageous and an extremely small drive motor is necessary. This feature possibly also deserves protection independent of the previously mentioned features, however, particularly in association with the further feature of the invention that the adjusting device includes a self-locking setting gear with a large transmission ratio. It is not only the large transmission ratio that contributes to the reduction of the drive forces, and hence to the dimensions of the drive shaft; the self-locking property of the setting gear also contributes because no retention forces have to be accepted by the drive shaft. A gear of the sliding wedge type is particularly advantageous.

The invention is explained in more detail below with reference to the drawing which shows an advantageous illustrative example.

DETAILED DESCRIPTION OF THE PREFERRED EMBODIMENT

Figure 1:
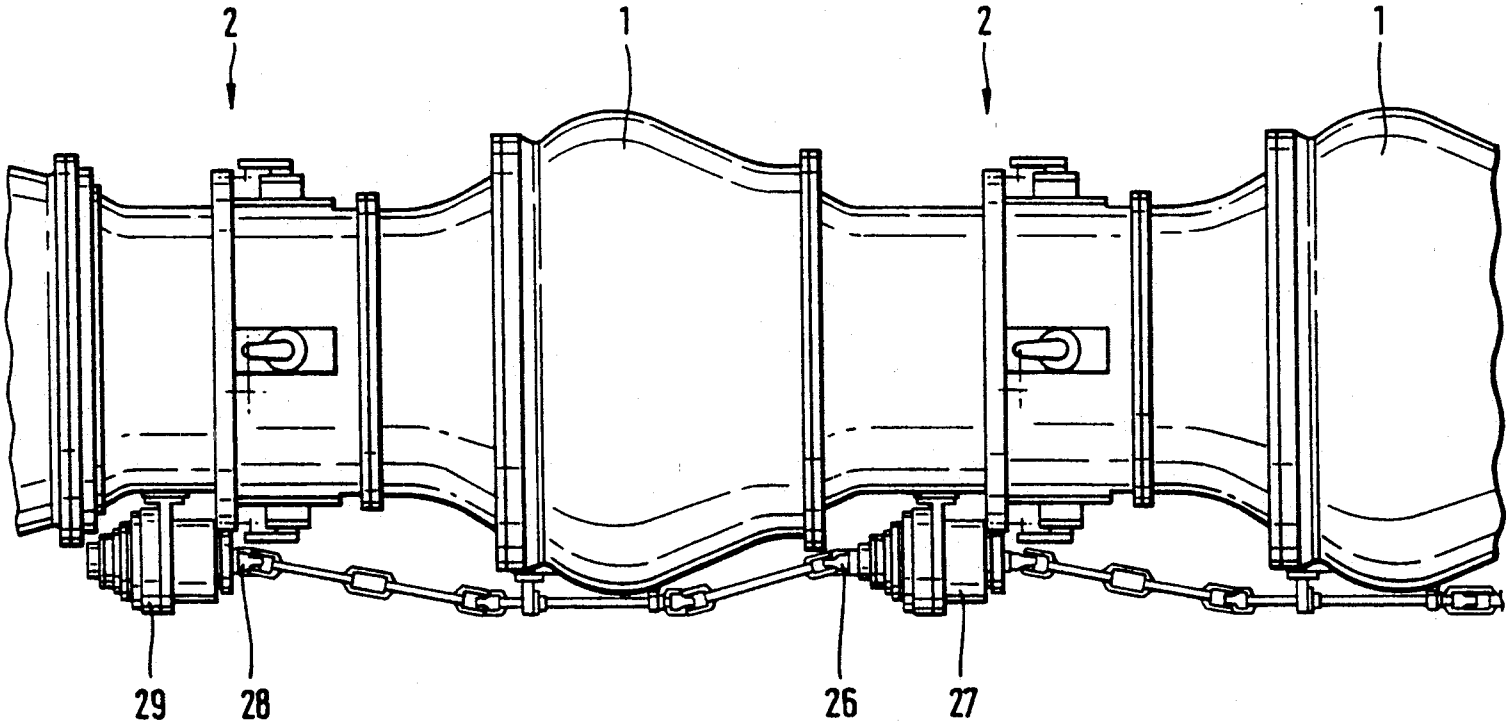
FIG. 1 shows an overall view of a two-stage pump arrangement
Figure 2:
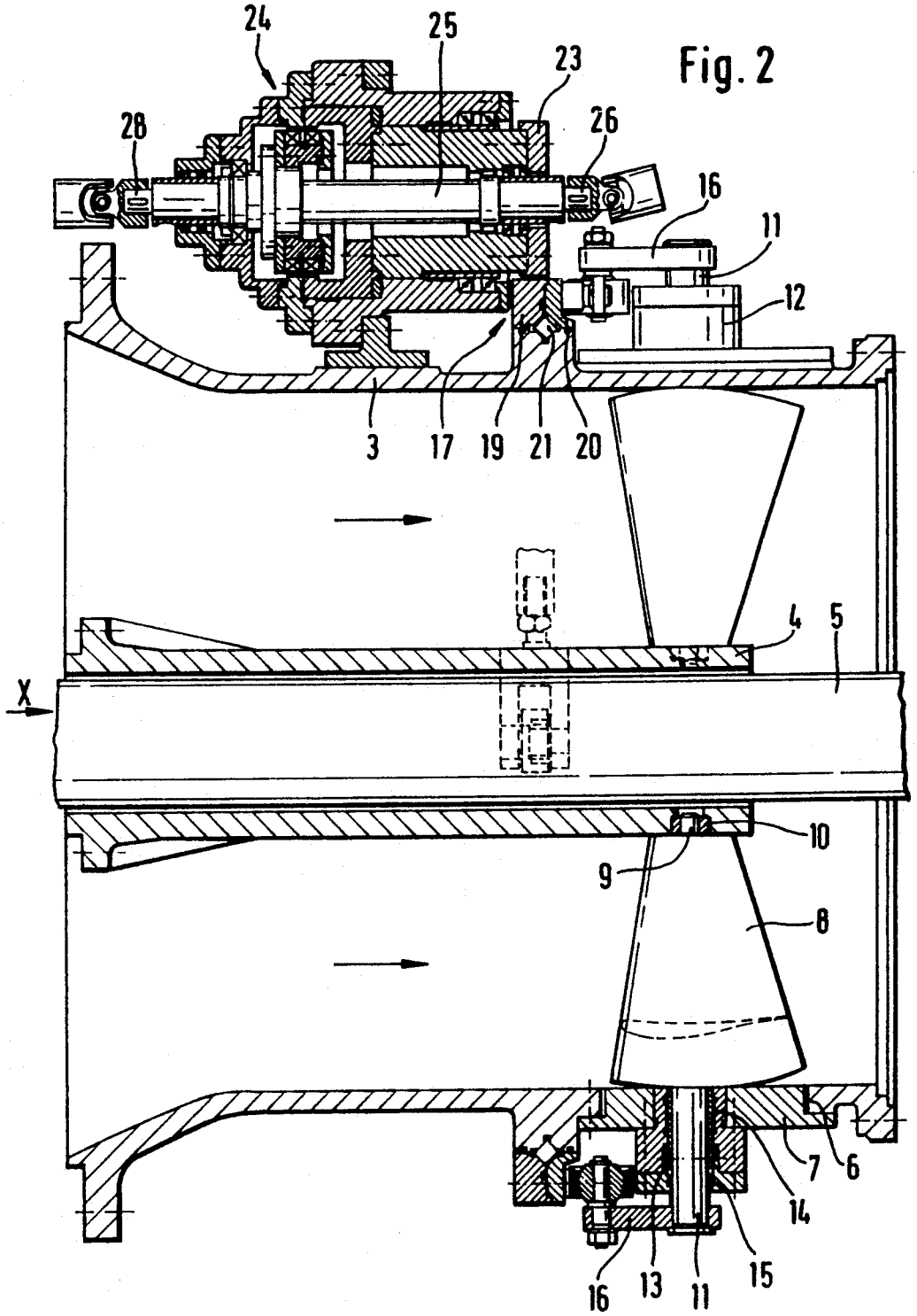
FIG. 2 shows a longitudinal section through a swirl controller for it.
Figure 3:
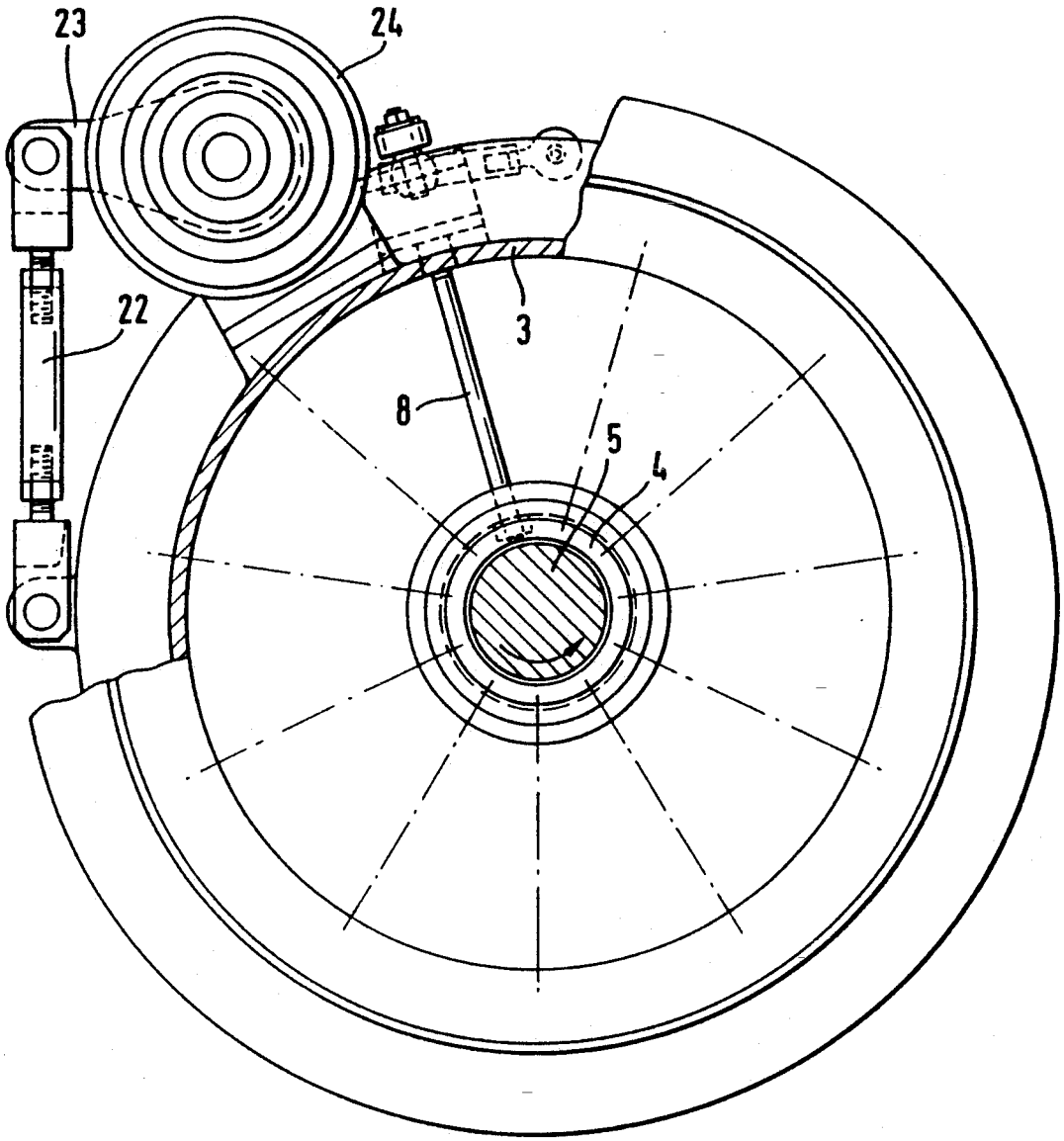
FIG. 3 shows a view of the swirl controller in the direction "X"
Figure 4:
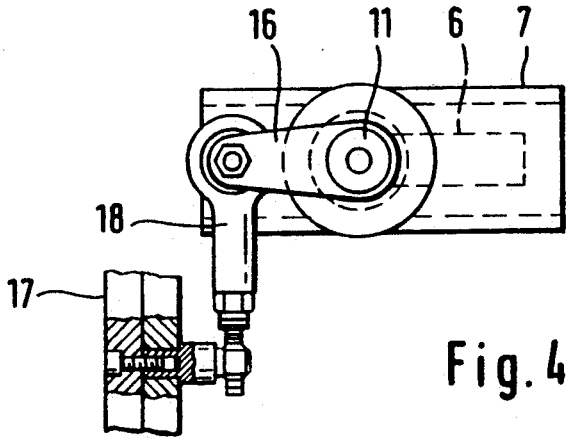
FIG. 4 shows a partial view in the direction "Z" of FIG. 2.

The pump casing appearing in FIG. 1 contains two pump stages 1, each of which is fitted with an upstream swirl controller 2. The casing 3, preferably bounded in circular shape in cross section, contains an unsplit, hollow hub 4 which is rigidly held by means of radial struts in the first pump stage of the casing 3 or from the guide vane hub of the pump stage, the pump shaft 5 passing through the central bore of the hub 4.

The casing 3 contains a number of slot-shaped assembly openings 6 evenly distributed around the periphery, each of these assembly openings being tightly closed by a cap 7. Their number and arrangement corresponds to the number and arrangement of guide vanes 8 which are arranged substantially radially within the flow duct. Their size is adequately dimensioned for the assembly and dismantling of the vanes. At their end near the center, the vanes 8 have a bearing trunnion 9 which is supported in a bearing 10 formed in the hub 4. At their outer end, the guide vanes 8 are rigidly connected to a guide-vane trunnion 11 which passes through a sealing and bearing arrangement 12 which is located as a tight fit in the cap 7. The arrangement includes a bearing 13 with spherical surfaces, a grease-filled sealing section 14 at the medium end and a seal 15 at the atmosphere end. The sealing section 14 has a relatively large clearance in order to permit alignment errors of the guide-vane trunnion 11. The bearing 13 is similarly insensitive to alignment errors. The complete sealing and bearing device 12 and the trunnion 11 can be dimensioned to be relatively light because the guide vane is not cantilevered.

The adjusting device includes a setting lever 16 which acts on the trunnion 11 and can be pivoted by a setting ring 17 via a link 18. The setting ring 17, which is made up of two partial rings 19, 20, is rotatably supported on the casing 3 by means of the rolling bodies 21. It connects the setting lever 16 of all the guide vanes so that these are always adjusted simultaneously and by the same amounts.

The position of the setting ring 17 is determined by a link 22 from the position of a lever 23 which is the output element of a setting drive 24 which is fastened on the casing 3 parallel to the axis and, in the illustrative example, is formed from the sliding wedge gear already mentioned above. Its drive shaft 25 is designed as a through shaft. This means that when several swirl controllers are arranged in series, as is indicated in FIG. 1, it is only necessary to provide one drive shaft train because the output end 26 of the drive shaft of a previous gear 27 can be connected to the input end 28 of the subsequent gear 29.

The gear has a large transmission ratio (1:85 for example) and is self-locking so that the drive shaft can be designed to be light and can contain articulated parts without any complication worth mentioning. The gears are filled with grease and sealed so that the complete arrangement can, if required, be located below the surface of the liquid.

We claim:

1. Prerotational swirl controller for rotary pumps having a flow duct enclosed by a casing and a plurality of guide vanes located substantially radially within the casing, each guide vane being supported on the casing at one end and on a permanently located hub at the other end, and having an adjusting device for adjusting the guide vanes, wherein a bearing for supporting a guide vane is located on a cap piece which closes an opening in the casing appropriate to the cross-sectional size of the guide vane, the bearing being designed to be tolerant of alignment errors.

2. Prerotational swirl controller as claimed in claim 1, wherein the adjusting device includes a rolling-contact supported ring for the common adjustment of the guide vanes.

3. Pre-rotational swirl controller as claimed in claim 2, wherein the adjusting device includes a setting gear with a through drive shaft.

4. Pre-rotational swirl controller as claimed in claim 2, wherein the adjusting device includes a self-locking setting gear.

5. Prerotational swirl controller as claimed in claim 1, wherein the adjusting device includes a setting gear with a through drive shaft.

6. Pre-rotational swirl controller as claimed in claim 5, wherein the adjusting device includes a self-locking setting gear.

7. Prerotational swirl controller as claimed in claim 1, wherein the adjusting device includes a self-locking setting gear.

8. Pre-rotational swirl controller as claimed in claim 7, wherein the transmission ratio of the gear is about 1:85.

9. Pre-rotational swirl controller as claimed in claim 7, wherein the gear is of the sliding wedge type.

10. A pre-rotational swirl controller for a rotary pump, comprising:

a casing enclosing a flow duct, the casing having a plurality of openings, a plurality of guide vanes located substantially radially within the casing, each guide vane being dimensioned to be removable through one of the openings in the casing, and having opposite first and second ends, the first end being supported on the casing, a permanently located hub for supporting the second end of each guide vane, adjustment means positioned on said controller for adjusting each guide vane, and a plurality of closures for closing the plurality of openings in the casing, each closure having a bearing for supporting a guide vane on the casing, the bearing being tolerant of alignment errors.

11. A pre-rotational swirl controller as claimed in claim 10, wherein the adjustment means includes a rolling-contact supported ring for the common adjustment of the plurality of guide vanes.

12. A pre-rotational swirl controller as claimed in claim 11, wherein the adjustment means includes a setting gear with a through drive shaft.

13. A pre-rotational swirl controller as claimed in claim 11, wherein the adjustment means includes a self-locking setting gear.

14. A pre-rotational swirl controller as claimed in claim 10, wherein the adjustment means includes a setting gear with a through drive shaft.

15. A pre-rotational swirl controller as claimed in claim 14, wherein the adjustment means includes a self-locking setting gear.

16. A pre-rotational swirl controller as claimed in claim 10, wherein the adjustment means includes a self-locking setting gear.

17. A pre-rotational swirl controller as claimed in claim 16, wherein the transmission ratio of the setting gear is about 1:85.

18. A pre-rotational swirl controller as claimed in claim 16, wherein the setting gear is of the sliding wedge type.

* * * * *